US011840928B1

(12) United States Patent
Lin et al.

(10) Patent No.: US 11,840,928 B1
(45) Date of Patent: Dec. 12, 2023

(54) GEOLOGICAL SAMPLING BACKPACK DRILLING MACHINE

(71) Applicant: Chengdu University of Technology, Chengdu (CN)

(72) Inventors: Liangbiao Lin, Chengdu (CN); Jianchao Zheng, Chengdu (CN); Yu Yu, Chengdu (CN); Fanchi Nan, Chengdu (CN); Fengbin Liu, Chengdu (CN); Shuncheng Tang, Chengdu (CN); Jianchao Wang, Chengdu (CN); Jialiang Su, Chengdu (CN); Siyu Liu, Chengdu (CN); Xiaoliang Deng, Chengdu (CN)

(73) Assignee: CHENGDU UNIVERSITY OF TECHNOLOGY, Chengdu (CN)

( * ) Notice: Subject to any disclaimer, the term of this patent is extended or adjusted under 35 U.S.C. 154(b) by 0 days.

(21) Appl. No.: 18/324,109

(22) Filed: May 25, 2023

(30) Foreign Application Priority Data

Mar. 10, 2023 (CN) ..... 202310226964.7

(51) Int. Cl.
*E21B 7/00* (2006.01)
*E21B 7/02* (2006.01)

(52) U.S. Cl.
CPC ..... *E21B 7/027* (2013.01); *E21B 7/028* (2013.01)

(58) Field of Classification Search
CPC ..... E21B 7/027; E21B 7/028
See application file for complete search history.

(56) References Cited

U.S. PATENT DOCUMENTS 2,929,611 A * 3/1960 Read ..... E21B 19/087 173/159

FOREIGN PATENT DOCUMENTS

CN 211081780 U 7/2020
CN 217841550 U 11/2022

* cited by examiner

*Primary Examiner* — Giovanna Wright
(74) *Attorney, Agent, or Firm* — Andrew C. Cheng

(57) ABSTRACT

The present disclosure providing a geological sampling backpack drilling machine includes a housing, a drilling device movably received in the housing, a seat arranged on the housing, and a bracket detachably connected to the housing via a limiting rotator, with an angle between the bracket and the housing being variable; the seat arranged between a tip of a drilling rod and the bracket, and rotating around the drilling rod as an axis thereof; a rotating member arranged on a surface of the seat and surrounding around the drilling rod to detachably connect with a supporting post, both the supporting post and the bracket cooperatively supporting the drilling device; the drilling rod passing through the housing and the seat; both the bracket and the supporting post supporting the drilling device that is obliquely drilled and the housing for enabling the drilling device to stably drill at an inclined state.

10 Claims, 7 Drawing Sheets

GEOLOGICAL SAMPLING BACKPACK DRILLING MACHINE

CROSS-REFERENCE TO RELATED APPLICATION

This application is claimed priority to Chinese Patent Application No. CN202310226964.7 entitled "GEOLOGICAL SAMPLING BACKPACK DRILLING MACHINE" and filed on Mar. 10, 2023, the content of which is hereby incorporated by reference in its entirety.

BACKGROUND

Technical Field

The present disclosure generally relates to the field of geological exploration technologies, and especially relates to a geological sampling backpack drilling machine.

Description of Related Art

In the field of geological samplings, a sampling work often carried out can be mainly divided into a soil sampling and a rock sampling. During an investigation and sampling process, soil samples or rock samples need to be collected from a selected area, based on an actual state reflected by the soil samples or the rock samples, formation rules of geological conditions in the selected area can be studied to provide basic geological data for scientific researches and further geological exploration works, which is a fundamental work that provides necessary data for subsequent mineral resource exploration and deployment, and is of great significance.

In terms of rock sampling in the field of geological surveys, sampling modes can be divided into a surface sampling mode and an underground sampling mode. A difference between the surface sampling mode and the underground sampling mode lies in different objects that have been sampled, the surface sampling mode often targets visible surface rock structures, while the underground sampling mode targets underground rock structures buried below the ground; even though the sampling environment between the surface sampling mode and the underground sampling mode is different, both sampling operations require to use corresponding sampling tools such as drilling machines to smoothly proceed the sampling process. The drilling machines used in the two sampling modes are often significantly different, for example, the drilling machines used in the underground sampling mode need to overcome deep obstacles between a soil layer and a rock layer below a ground surface, and the drilling machines used in the underground sampling mode is mostly large scaffolding drilling machines, so that workloads for transporting and assembling the drilling machines are huge, which is only suitable for drilling and extracting deep rock samples. On the other hand, the drilling machines used for surface rock samplings and shallow rock samplings are correspondingly more compact, and often carried in the form of backpack drilling machines, which are easy to transport to complex terrain locations for sampling surface rock samples that are required.

It can be seen that the backpack drilling machines used for the surface sampling mode need to reduce a large number of additional structures for easy portability, which includes support structures used in bracket drilling machines that are commonly used for stabilizing a drilling direction thereof.

Therefore, a current backpack drilling machine on the market mostly includes a grip and a drilling rod for stabilizing the backpack drilling machine, when the backpack drilling machine is working, the grip is held by users to stabilize an overall gravity center of the backpack drilling machine on the drilling rod, and then drill vertically downwards to effectively control the drilling direction of the drilling machine and prevent the drilling rod from deviating from the normal drilling direction due to influences of the gravity center of the backpack drilling machine. The drilling rod itself serves as a drilling tool and also serves as a stable support point for the overall drilling machine.

It can be seen that, in order to avoid the drilling direction of the drilling machine from being affected by the gravity center of the drilling machine, it is very difficult for operators to drill in a way other than the vertical downward direction of a drill bit of the drilling machine, even for surface rocks, the operator needs to be located above the rock and drill vertically downwards. While, for certain rock structures that can't be drilled vertically downwards, such as inclined rocks exposed on a wall of the rock, the drilling machine is very difficult to be used in such conditions, even if the drilling machine that drills along an inclined drilling direction can be forcibly carried out by manually lifting and supporting the drilling machine, the drilling direction is likely to be further offset due to vibrations and the gravity center shift of the drilling machine itself, thereby ultimately affecting the quality of the rock samples that have been collected; at the same time, drilling holes that bend due to drilling offset are not conducive to separating the collected rock samples from the rocks, which significantly limits the backpack drilling machines to be used for drilling such rocks.

In addition, the drilling machine will inevitably vibrate due to forces exerted by the rock during the drilling process, which is particularly prominent during drilling hard rock samples. Due to a lack of a stable support structure for supporting the backpack drilling machine, corresponding measures often rely on manual labors to stabilize the vibration of the drilling machine. On the one hand, effectiveness of manual labors in combating vibration during the drilling process is limited, so that it is easy to cause systematic errors of the rock samples that have been obtained; and on the other hand, it greatly consumes labor costs and reduces work efficiency.

SUMMARY

The technical problems to be solved: in view of the shortcomings of the related art, the present disclosure provides a geological sampling backpack drilling machine which can provide corresponding auxiliary support structures, to effectively overcome problems that a drilling direction of the backpack drilling machine caused by vibration and a gravity center of the backpack drilling machine during a rock drilling process is changed, to further affect a smooth progress of collecting rock samples and qualities of the rock samples that are collected.

In order to solve at least one of the above technical problems, a technical solution provided by the present disclosure is:

a geological sampling backpack drilling machine according to an embodiment of the present disclosure includes a housing, a drilling device and a seat; wherein the housing is an internal-hollow container, with at least one set of limiting rotators arranged on a surface thereof for connecting with a bracket, the bracket detachably connected to the housing through the at least one set of limiting rotators to play a supporting role applied on the housing; and a first included angle can take any value within a range of 0°-90° by the at least one set of limiting rotators, and wherein the first included angle is an angle that is formed between the bracket and a first plane, and the first plane is a plane parallel to a horizontal plane where an axis of the housing is located. It can be seen that a function of the limiting rotator is to limit the housing to maintain at a certain angle, to keep a fixed angle between the limiting rotator and the bracket, and the fixed angle is a drilling angle of the drilling machine on a surface of the rock that is determined according to actual situations; and wherein the drilling device is connected to a drilling rod and configured to drive the drilling rod and a corresponding drilling equipment to move, a surface of the drilling device matched with an interior of the housing, so that the drilling device can move within the housing; similar to a conventional drilling machine in the art, the drilling machine of the present disclosure is also configured to supply power for a bit of the drilling rod by connecting to the drilling rod, the drilling rod and the drilling device are commonly detachable connected with each other in the art; when the drilling machine is in a drilling operation, the housing is fixed under an action of the bracket, and the drilling device needs to keep moving in the housing to reflect a drilling effect, in order to ensure the drilling device to smoothly move in the housing, a shape of the drilling device of the present disclosure matches with the internal of the housing; it is worth noting that limitations of an appearance of the drilling device of the present disclosure are not intended to limit a working structure inside the drilling device, but is only to match with the internal shape of the housing; that is, a basic structure of the drilling device of the present disclosure and a drilling principle are the same as that of the drilling machine of the related art, which are driven by a motor to drive the drilling rod to rotate; therefore, it can be understood that, any backpack drilling machine in the related art, after being wrapped with a shell that matches with the internal of the housing of the present disclosure, can be set inside the housing of the present disclosure to achieve the same function as the backpack drilling machine of the present disclosure; and wherein the seat is set on the surface of the housing, and arranged between a tip of the drilling rod and the bracket and rotates around the drilling rod; at least two sets of rotating members arranged on the surface of the seat and distributed around the drilling rod for detachably connecting with a supporting post, a second included angle taken any value within the range of 0°-90° by the at least two sets of rotating members, wherein the second included angle is a common plane angle between the supporting post and the drilling rod; that is, the supporting post arranged on the seat can rotate around the rotating member, and a support state of the seat will vary depending on different operating conditions; the supporting post adjusts its angle through the rotating member, so that the supporting post can always point to an optimal support point that is provided by surrounding environments; when using the drilling machine, first the seat is turned to a specific position, and then the supporting post that is connected to the seat is adjusted to rotate to a suitable angle, so that the supporting post can stably contact and support at the optimal support point that is provided by the surrounding environment, thereby further stabilizing the entire drilling machine; the drilling rod passes through the surface of the housing and the seat, respectively; it can be seen that the bracket and the supporting post cooperatively support the drilling rod from at least two directions, compared to using the bracket or the supporting post alone, support stability for the drilling rod of the present disclosure can be effectively improved.

The present disclosure provides the advantages as below:

firstly, the present disclosure providing the bracket can support the drilling device and the housing that are drilled in an inclined state, and the supporting post can further stabilize the gravity center of the drilling machine during drilling rocks according to an actual situation of a work site; compared to the bracket structure of a large drilling machine, the bracket and the supporting post of the present disclosure are easy to disassemble, carry, and set under a condition of normally carrying and using the backpack drilling machine, and can be used to assist the drilling machine to stably drill or sample rocks at the inclined state, to ensure integrity of boreholes and rock samples without needing additional human support, and expand applicability of the backpack drilling machine;

secondly, the housing and the supporting post are provided to effectively counteract vibrations during the drilling process and stabilize the gravity center of the drilling machine, reduce labor costs of stabilizing the drilling machine, ensure stability of boreholes and qualities of collected rock samples, and effectively improve the efficiency of rock drilling operations.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. It should be understood that the drawings described below are only to illustrate some embodiments of the present disclosure, rather than being regarded as limitations of a protection scope of the present disclosure. Obviously, for one of ordinary skill in the related art, other drawings can be obtained according to the drawings below on the premise of no creative work.

The element labels according to the embodiment of the present disclosure shown as below:

1000 housing, 1100 limiting rotator, 1101 supporting clip, 1102 connecting block, 1103 opening, 1104 rotating shaft, 1105 contacting piece, 1106 fixing groove, 1107 limiting rod, 1108 spring, 1109 bolt, 1110 tooth, 1111 slot, 1200 lifting device, 1201 lifting board, 1202 sliding block, 1203 connecting block, 1204 piston rod, 1205 piston cylinder, 1206 reflux pathway, 1207 switch, 1208 drainage pathway, 1209 one-way valve, 1210 hydro-cylinder, 1211 spring-piston, 1212 lifting recess, 1213 sliding groove, 1300 cover, 2000 drilling device, 2100 coupling, 2200 water supply pipe, 2300 grip, 3000 seat, 3100 rotating member, 3200 rotating handle, 3300 supporting post, 3301 outer sleeve, 3302 inner sleeve, 3303 connecting portion, 4000 drilling rod, 5000 bracket, 6000 core barrel, A first included angle, B first plane, C second included angle.

DETAILED DESCRIPTION

A further detailed description of the present disclosure will now be made in detail to embodiments, examples of which are illustrated in the accompanying drawings.

In order to more clearly understand the technical solution hereinafter in embodiments of the present disclosure, reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described exemplary embodiment of the present disclosure, all other embodiments obtained by one of ordinary skill in the related art without the need for a creative labor are within the protection scope of the present disclosure. Therefore, the following detailed description of the embodiments of the present disclosure provided in the accompanying drawings is not intended to limit the scope of the present disclosure, but only to represent selected embodiments of the present disclosure.

Embodiments

Figure 1:
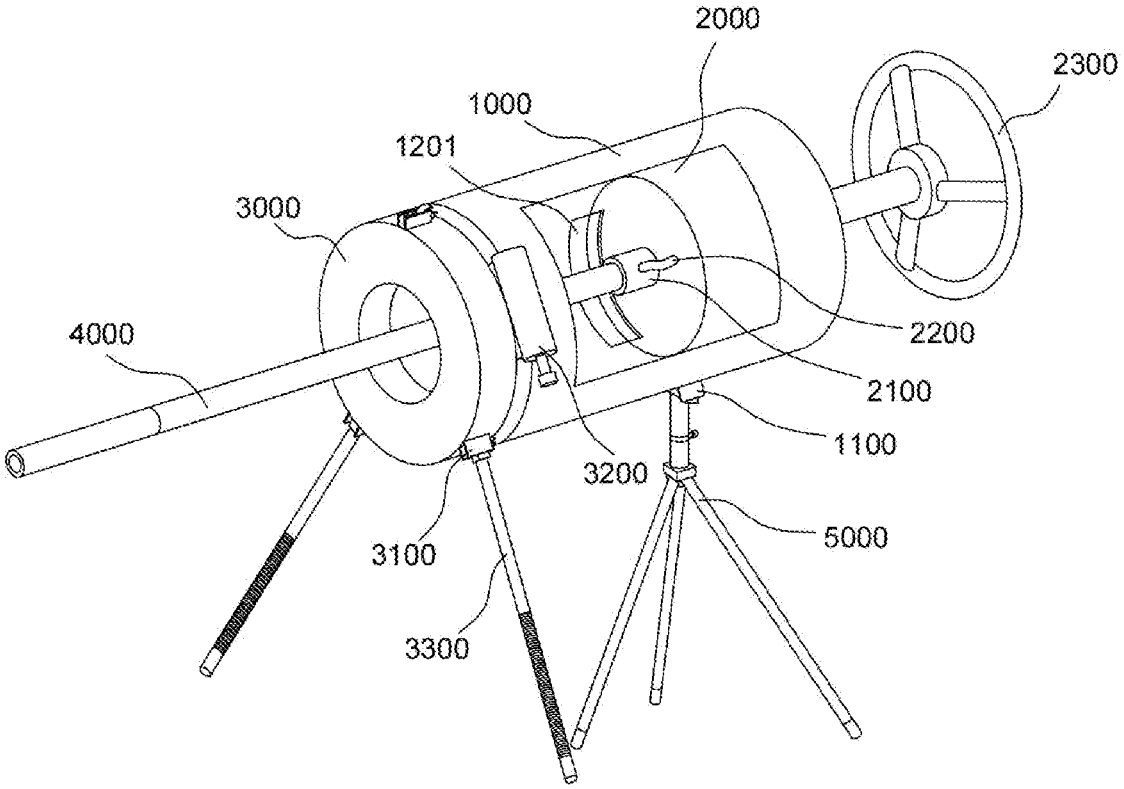
FIG. 1 is a schematic view of a geological sampling backpack drilling machine in accordance with an embodiment of the present disclosure.

Referring to FIG. 1, a geological sampling backpack drilling machine in accordance with an embodiment of the present disclosure includes:

a housing 1000, a drilling device 2000 and a seat 3000. The housing 1000 is an internal-hollow container, with at least one set of limiting rotators 1100 arranged on a surface thereof for connecting with a bracket 5000. In an embodiment of the present disclosure, there are one set of limiting rotators 1100 to connect with the bracket 5000; the bracket 5000 is detachably connected to the housing 1000 through the one set of limiting rotators 1100 to play a supporting role applied on the housing 1000; types of the bracket 5000 of the embodiment of the present disclosure include, but are not limited to, tripods and tripods that are commonly used in the art. It can be seen that the brackets for playing a combined support role in the conventional technology can be used to play a corresponding support role of the embodiment of the present disclosure; therefore, an only difference between the bracket of the embodiment of the present disclosure, and the conventional bracket is that: there is a specific junction on a support end of the bracket for combining with the limiting rotator 1100, at the same time, for considering material costs and portability, the bracket 5000 of the embodiment of the present disclosure is preferably a tripod.

Figure 8:
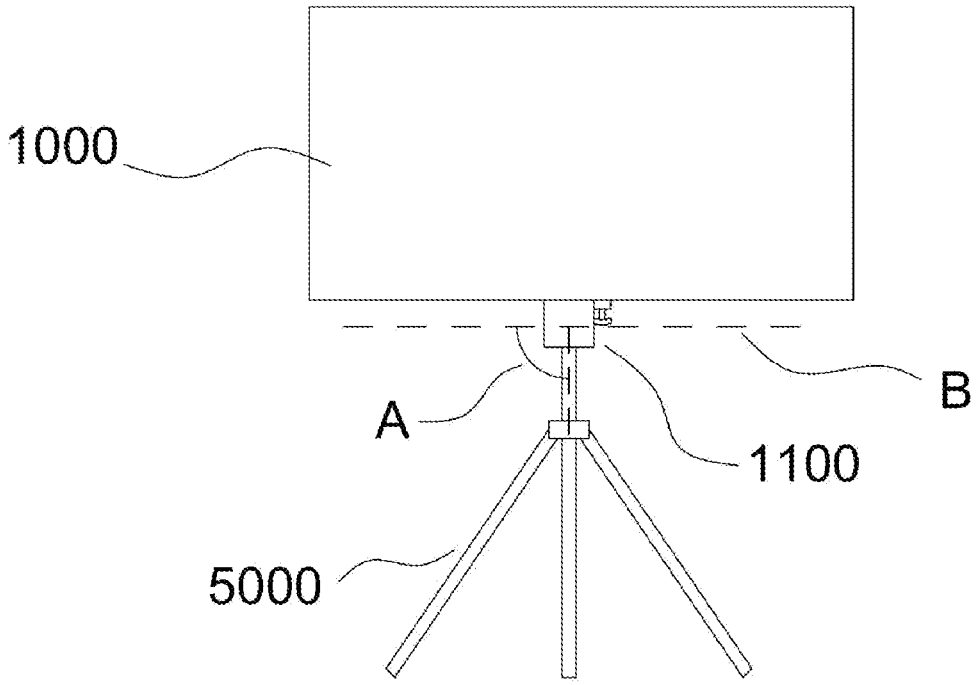
FIG. 8 is a schematic view of a first included angle and a first plane of the geological sampling backpack drilling machine of FIG. 1.

A first included angle A can take any value within a range of 0°-90° by the limiting rotator 1100, and wherein the first included angle A is an angle that is formed between the bracket 5000 and a first plane 13, and the first plane B is a plane parallel to a horizontal plane where an axis of the housing 1000 is located. Referring to FIG. 8, the limit rotator 1100 is to connect the bracket 5000 with the housing 1000, and configured to enable the housing 1000 to rotate relative to the bracket 5000. When the bracket 5000 is supported on the ground and fixed, an angle that can be adjusted by taking the bracket 5000 as a pivot is actually the housing 1000, so that the limiting rotator 1100 is actually to play a role for allowing the housing 1000 to rotate to a desired angle and then the housing 1000 is fixed by the limiting rotator 1100, that is, the first included angle A shown in FIG. 8 is adjusted, and then a pointing angle between the drilling device 2000 that is received in the housing 1000, and a drilling rod 4000 connected with the drilling device 2000, is adjusted.

Figure 2:
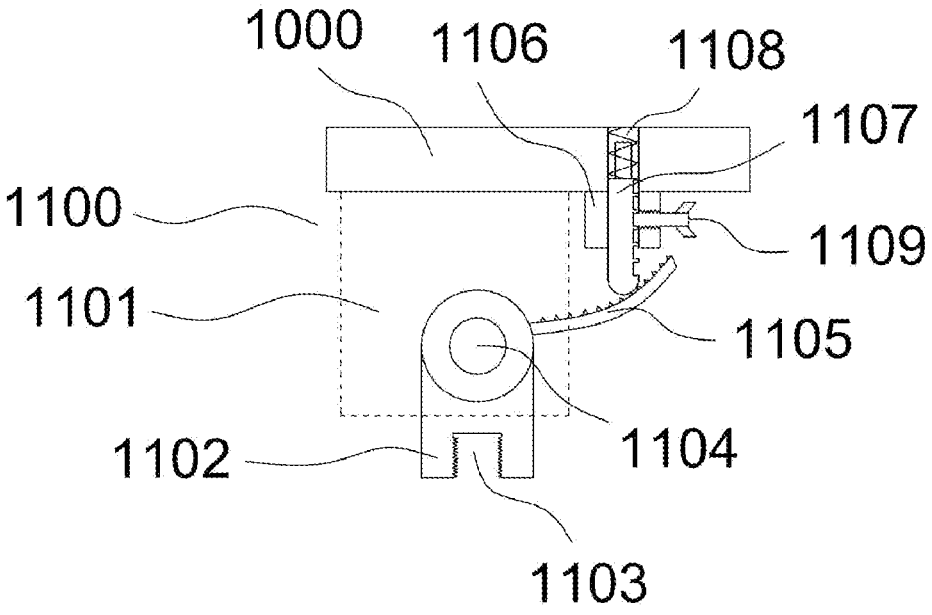
FIG. 2 is a schematic view of a limiting rotator of the geological sampling backpack drilling machine of FIG. 1.

Therefore, in order to implement a fixed effect of the limiting rotator 1100 after rotating the limiting rotator 1100, in an embodiment of the present disclosure, the limiting rotator 1100 is designed as shown in FIG. 2, and includes at least two sets of supporting clips 1101, a connecting block 1102, and a fixing groove 1106. Both the at least two sets of supporting clips 1101 and the fixing groove 1106 are arranged on a surface of the housing 1000, with two sets of supporting clips 1101 opposite to each other, and a rotating shaft 1104 connected between the two sets of supporting clips 1101, the connecting block 1102 sleeved on the rotating shaft 1104 to rotate around the rotating shaft 1104 that are formed between the two supporting clips 1101, an opening 1103 formed on the connecting block 1102 and connected with the bracket 5000, and a contacting piece 1105 arranged on the connecting block 1102 to rotate around the rotating shaft 1104. The opening 1103 is provided to detachably connect with the bracket 5000, a connection way between the opening 1103 and the bracket 5000 includes, but is not limited to, a buckle connection, a hinge connection, a bonding connection, a mortise and tenon connection and a threaded connection. In order to facilitate disassembly, in an embodiment of the present disclosure, a threaded connection is used to connect a portion of the bracket 5000 away from support legs of the bracket 5000, with the opening 1103, thereby connecting the bracket 5000 to the housing 1000 in an order of the limiting rotator 1100 and the housing 1000. It can be seen from the above mentioned that during an actual setting of the drilling machine, the bracket 5000 can't be moved arbitrarily and the connecting block 1102 connected to the bracket 5000 is also fixed, so that a rotating pivot point is formed at the rotating shaft 1104 to allow the supporting clip 1101 and the housing 1000 connected to the supporting clip 1101 to freely rotate around the rotating shaft 1104, thereby achieving the aforementioned function of allowing the housing 1000 to rotate to the required angle.

Furthermore, a limiting rod 1107 with a spring 1108 is arranged on the fixing groove 1106, and moved in the fixing groove 1106 under an action of the spring 1108, so that the limiting rod 1107 can be in contact with the contacting piece 1105 that rotates to any position around the rotating shaft 1104, to fix the contacting piece 1105 at a current position thereof; a bolt 1109 threaded in the fixing groove 1106 and being in contact with the limiting rod 1107 so that the limiting rod 1107 can be fixed by both the bolt 1109 and the spring 1108 that are in contact with the limiting rod 1107. After the housing 1000 rotates to any desired angle, a corresponding structure is required to limit and fix the housing 1000; therefore, in an embodiment of the present disclosure, the fixing groove 1106 and the limiting rod 1107 are provided to limit and fix the housing 1000, and a basic fixation principle that both the fixing groove 1106 and the limiting rod 1107 are provided to fix the housing 1000 is to use a friction force between the limiting rod 1107 and the contacting piece 1105 arranged on the connecting block 1102 for fixing the housing 1000. It can be seen that such fixing way requires continuous contact between the limiting rod 1107 and the contacting piece 1105 to generate a sufficient friction force, therefore, the spring 1108 is installed inside the fixing groove 1106 to provide a pushing force for the limiting rod 1107, to ensure that the limiting rod 1107 can maintain an outward movement trend and be in contact with the contacting piece 1105. It can be understood that an angle and an area of the contacting piece 1105 should be designed to ensure that the limiting rod 1107 can always be in contact with the contacting piece 1105. When the backpack drilling machine is not used, the connecting block 1102 can be rotated parallel to the housing 1000, while, when the backpack drilling machine is used, the connecting block 1102 is perpendicular to the housing 1000, or when the housing 1000 rotates, an angle between the connecting block 1102 and the housing 1000 is less than 90°, that is, the contacting piece 1105 can maintain contact with the limiting rod 1107 which is needed that a rotation angle between the connecting block 1102 and the housing 1000 is at least in 0°-90° range; when the limiting rod 1107 is pushed by the spring 1108 to rotate a certain angle to be in contact with the contacting piece 1105, it is necessary to keep the limiting rod 1107 to be fixed in a current position to further fix with the contacting piece 1105 that is in contact with the limiting rod 1107; in this way, the bolt 1109 is provided to engage with the fixing groove 1106 to squeeze and fix the limiting rod 1107. When the limiting rod 1107 needs to be moved, the bolt 1109 is moved out of the fixing groove 1106, at this time, the housing 1000 rotates to cause the contacting piece 1105 to rotate relative to the housing 1000, so as to squeeze the limiting rod 1107 at a suitable position; and then, the bolt 1109 is screwed into the fixing groove 1106 to squeeze and fix the limiting rod 1107, so that the limiting rod 1107, the contacting piece 1105, the connecting block 1102 and the housing 1000 are fixed to their current positions, thereby achieving a fixation effect after the angle between the contacting block 1102 and the housing 1000 is adjusted above mentioned.

In some embodiments of the present disclosure, a contact surface of the contacting piece 1105 that is in contact with the limiting rod 1107 is a rough surface with a plurality of teeth 1110 thereof, and a contact surface of the limiting rod 1107 that is in contact with the contacting piece 1105 is also a rough surface, each of the plurality of teeth 1110 clamped with the rough surface of the limiting rod 1107 to fix the limiting rod 1107. When an external force is not introduced, the contacting piece 1105 and the limiting rod 1107 are fixed with each other due to the friction force generated between the rough surface of the limiting rod 1107 and the plurality of teeth 1110, thereby fixing the contacting piece 1105 and the housing 1000 that is connected to the limiting rod 1107. In addition, the contacting piece 1105 and the limiting rod 1107 can also be fixed with each other by setting meshing teeth on both contact surfaces thereof, or by setting grooves on the contact surface of the contacting piece 1105 that match with corresponding parts of the limiting rod 1107 to fix the contacting piece 1105 and the limiting rod 1107. In an embodiment of the present disclosure, the rough surface and the plurality of teeth 1110 mentioned above are provided to fix the contacting piece 1105 and the limiting rod 1107.

In some embodiments of the present disclosure, a plurality of slots 1111 is arranged on a top surface of the limiting rod 1107, the bolt 1109 extending into each of the plurality of slots 1111 to fix the limiting rod 1107. Because the fixation effect that the bolt 1109 is perpendicularly squeezed on the limiting rod 1107 is limited, in an embodiment of the present disclosure, the plurality of slots 1111 are provided on the surface of the limiting rod 1107 to clamp with the bolt 1109, so as to obtain a better fixation effect of fixing the limiting rod 1107.

The drilling device 2000 is connected to a drilling rod 4000 and configured to drive the drilling rod 4000 and a corresponding drilling equipment to move, and a surface of the drilling device 2000 is matched with an interior of the housing 1000, so that the drilling device 2000 can move within the housing 1000. The backpack drilling machines that are commonly used in the art mostly provide a coupling 2100 and a water supply pipe 2200 as shown in FIG. 1 to connect with the drilling rod, so as to facilitate carrying and replacing the drilling rod. Therefore, the backpack drilling machine of the present disclosure uses the same method in the art to connect the drilling rod 4000 and the drilling device 2000; at the same time, generally speaking, a matching appearance only requires adding a layer of corresponding structural shell on an outer surface of an equipment, and internal structures does not need to be significantly different from the conventional equipment, therefore, internal driving structures of the drilling device 2000 of the present disclosure is not fundamentally different from structures of the conventional backpack drilling machine, which is not be repeated here.

Figure 9:
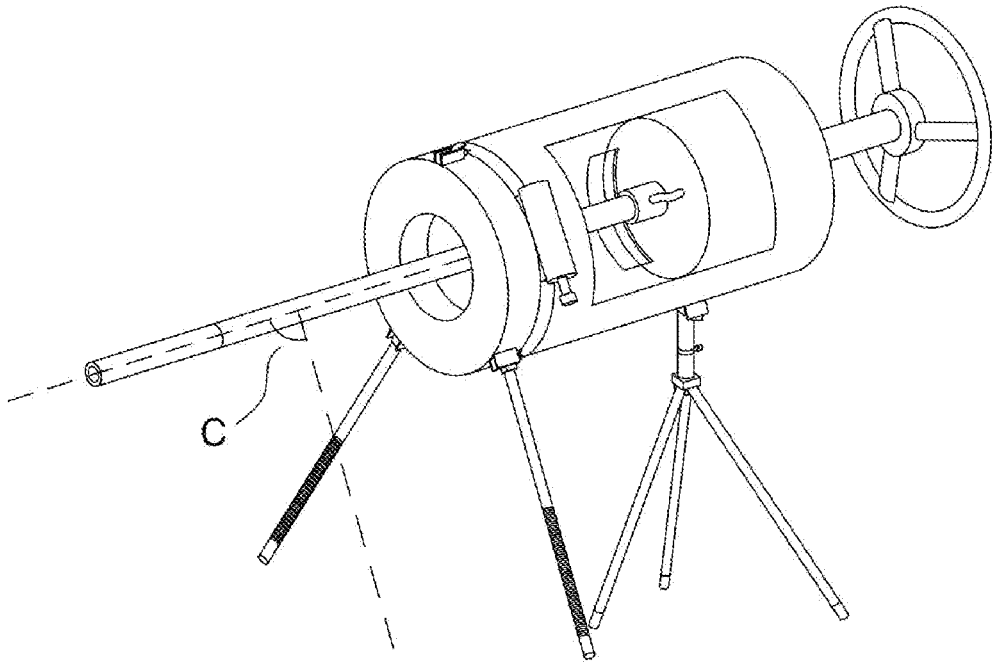
FIG. 9 is similar to FIG. 8, but shown a second included angle of the geological sampling backpack drilling machine of FIG. 1.

Referring to FIG. 1, a seat 3000 is arranged on the housing 1000 and the drilling rod 4000 passes through the surface of the housing 1000 and the seat 3000, respectively. The seat 3000 is set on the surface of the housing 1000, arranged between a tip of the drilling rod 4000 and the bracket 5000, and rotates around the drilling rod 4000; at least two sets of rotating members 3100 arranged on the surface of the seat 3000 and distributed around the drilling rod 4000 for detachably connecting with a supporting post 3300. In an embodiment of the present disclosure, there are three sets of rotating members 3100 that are equally spaced and arranged on the seat 3000, and the drilling device 2000 can move in the housing 1000. It is indicated that the overall gravity center of the backpack drilling machine can be changed during operating the backpack drilling machine. In this way, it is necessary to provide support points along a forward direction of the drilling rod 4000 to improve stability performances of the backpack drilling machine. Therefore, the seat 3000 that can rotate is arranged on the housing 1000, and the rotating member 3100 is also arranged on the seat 3000 to connected with the supporting post 3300, so that a second included angle C as shown in FIG. 9 can be arbitrarily selected within the range of 0°-90°, that is, the supporting post 3300 around the rotating member 3100 can arbitrarily rotate at any angle from 0° to 90°, thereby enabling the supporting post 3300 around the drilling rod 4000 to support the backpack drilling machine at any angle from 0° to 90°; a purpose that the supporting post 3300 is to use the rotating member 3100 to support the drilling machine on the nearest rock structure, the ground or rock walls when the drilling device 2000 drills the rock at an inclined angle, thereby providing additional support points in the drilling direction of the drilling machine, further dissipating vibrations generated in the drilling process and ensuring the drilling rod 4000 to stably drill the rock. In order to achieve the support function above mentioned, the seat 3000 can be a structure similar to a slewing support to rotate the seat 3000 freely; for a rotating fixed function that the rotating member 3100 needs to provide for the supporting post 3300, the rotating member 3100 can be set to a structure similar to or the same as the aforementioned limiting rotator 1100 to achieve the above required function. In this way, specific structures of the rotating member 3100 are not repeated here.

In an embodiment of the present disclosure, a rotating handle 3200 is arranged on the seat 3000 and configured to control a rotation of the seat 3000, which is convenient for users to adjust the rotation angle of the seat 3000.

Figure 10:
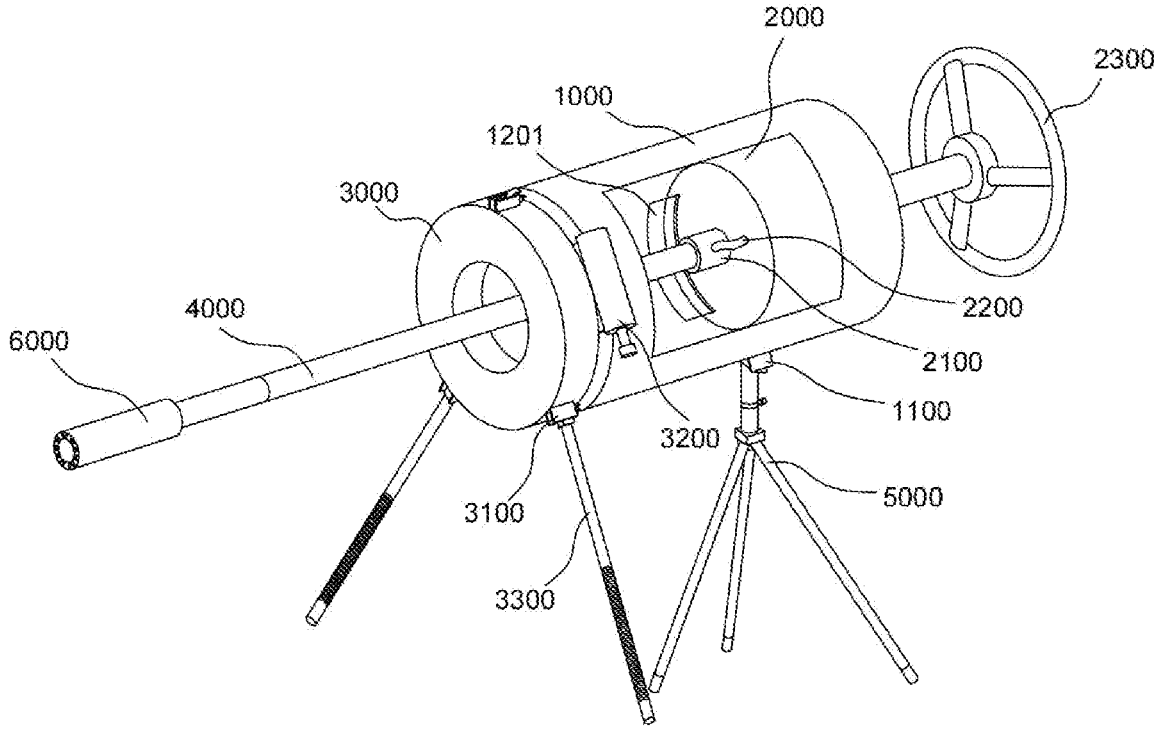
FIG. 10 is a schematic view of an overall structure of the geological sampling backpack drilling machine of FIG. 1, shown after a core barrel is set thereon.

Referring to FIG. 10, in some embodiments of the present disclosure, a tip of the drilling rod 4000 can be replaced from a conventional drill bit to a core barrel 6000 that is configured to collect rock samples, so that the drilling device 2000 can be also supported by the bracket 5000 and the supporting post 3300 in such collection process, so as to eliminate an impact of the core barrel 6000 due to vibrations of the drilling device 2000 during the sampling process, and ensure the quality of the collected rock samples.

Figure 3:
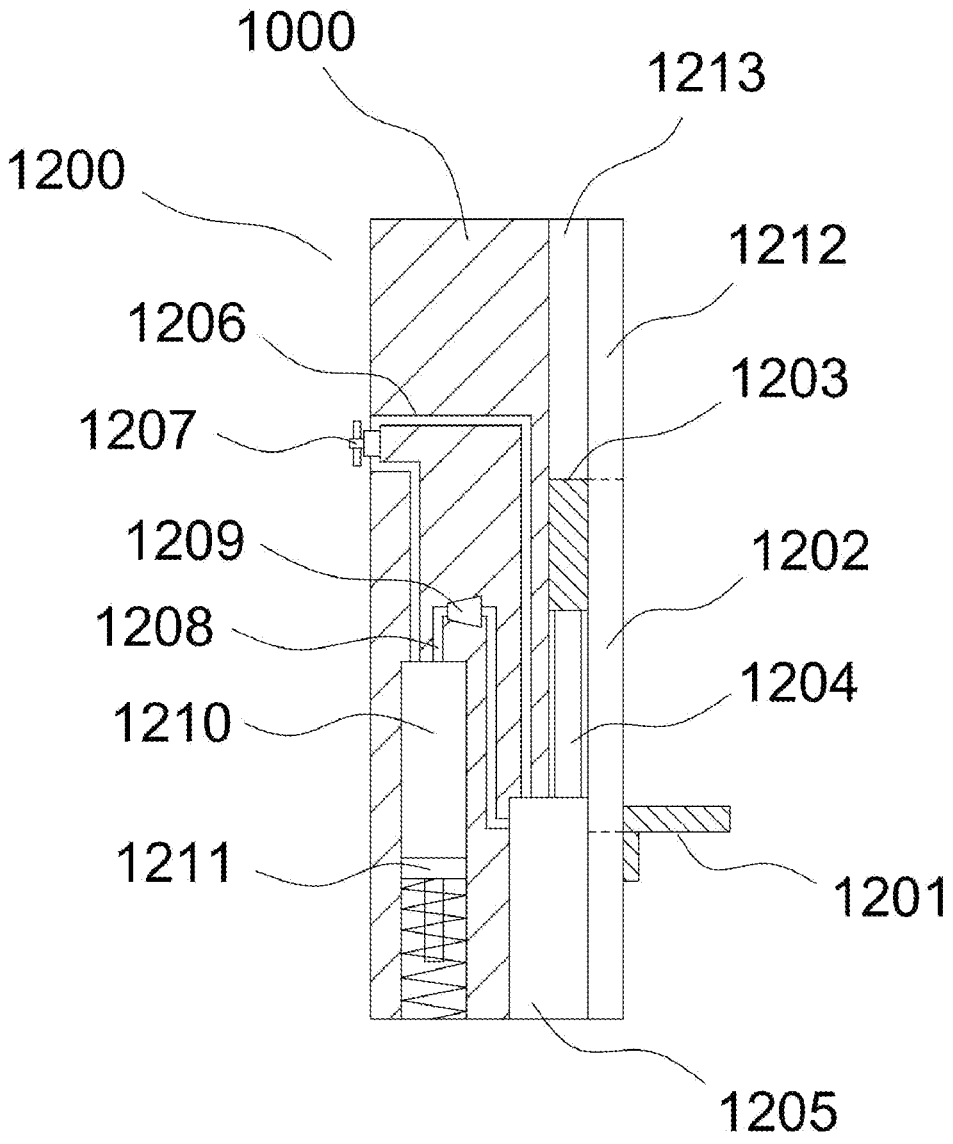
FIG. 3 is a schematic view of a lifting device of the geological sampling backpack drilling machine of the present disclosure.
Figure 4:
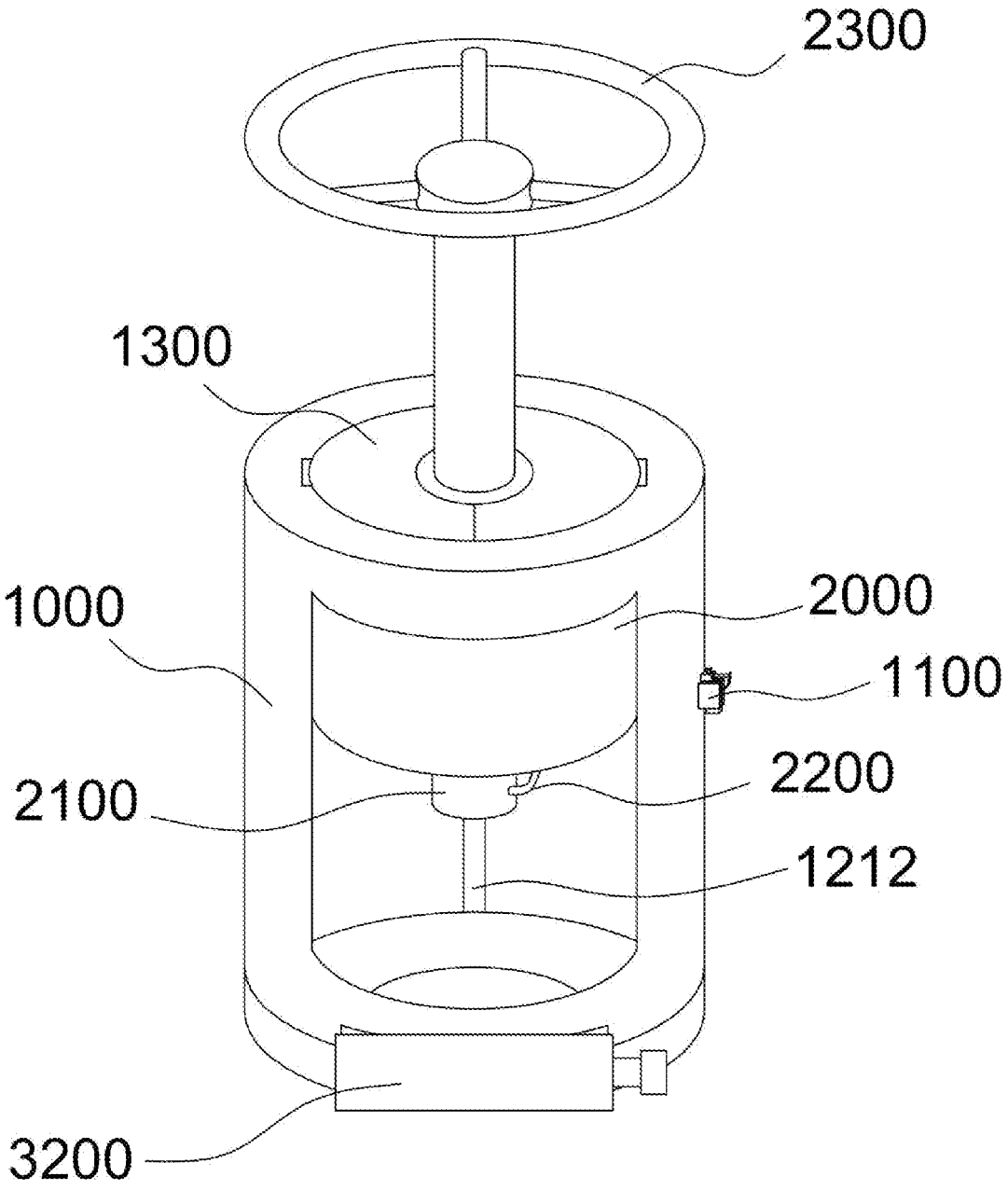
FIG. 4 is a schematic view of a cover connected to a housing of the geological sampling backpack drilling machine of the present disclosure.
Figure 5:
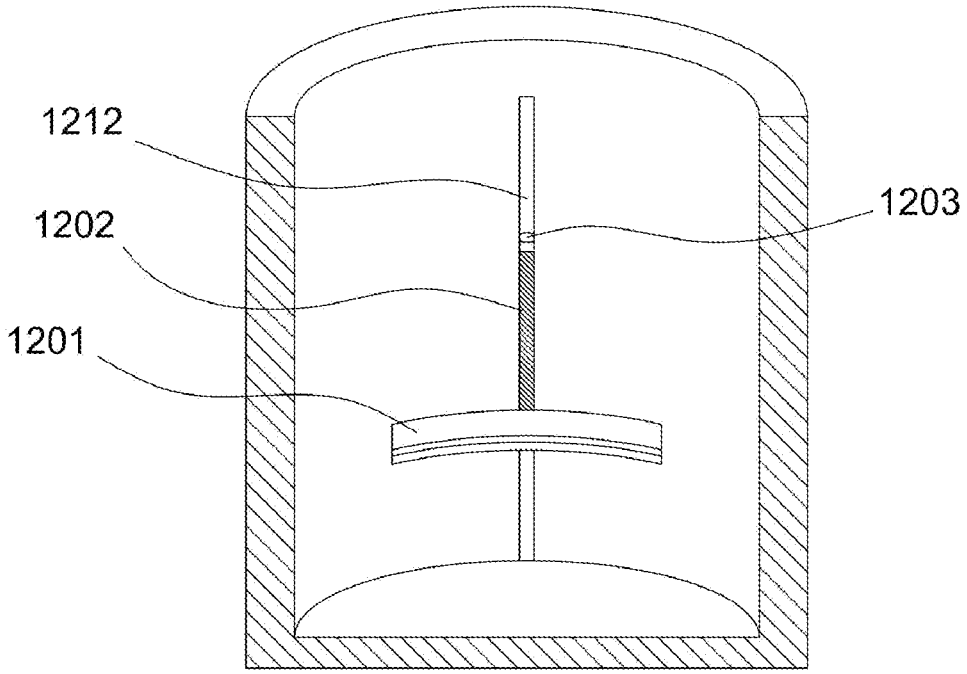
FIG. 5 is a cross-sectional view of the interior of the housing of the geological sampling backpack drilling machine of the present disclosure.
Figure 6:
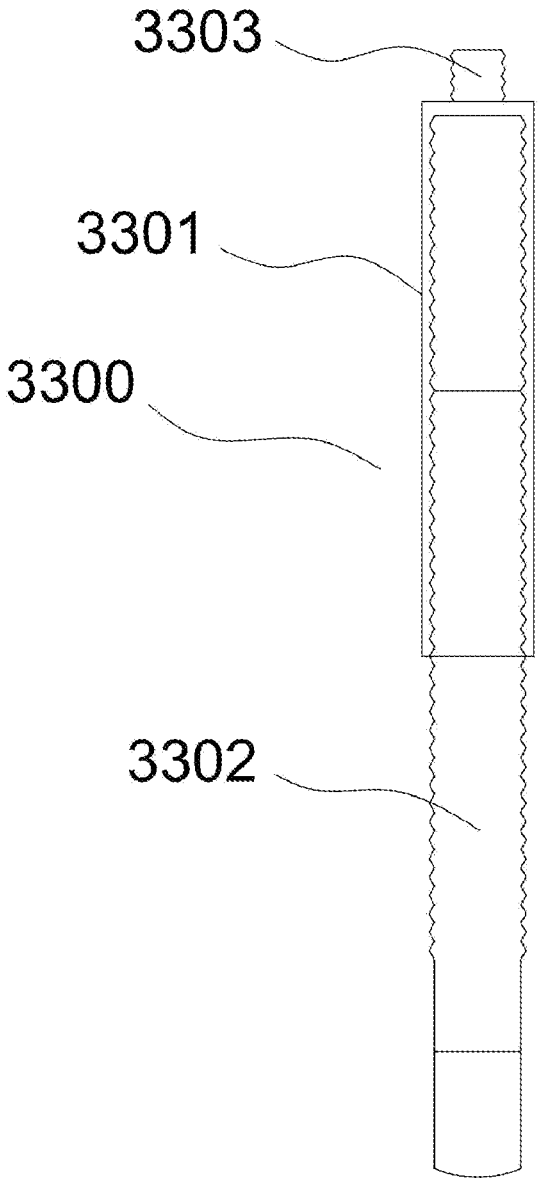
FIG. 6 is a schematic view of a supporting post of the geological sampling backpack drilling machine of the present disclosure.
Figure 7:
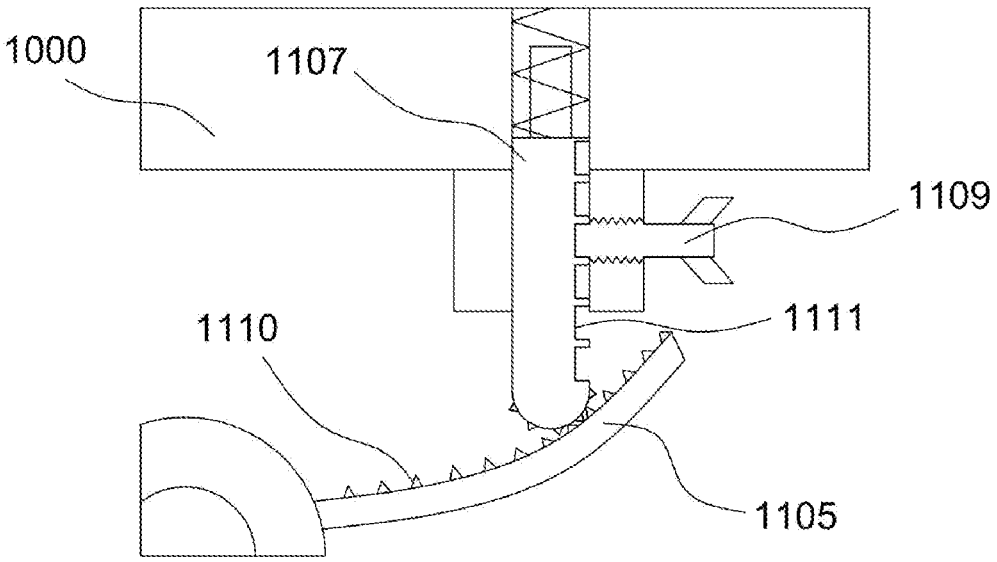
FIG. 7 is a partial enlarged view of a limiting rod of the geological sampling backpack drilling machine of the present disclosure.

Referring to FIG. 3 and FIG. 5, in an embodiment of the present disclosure, a lifting device 1200 is received in the housing 1000 for supporting the drilling device 2000 to move. Because that the housing 1000 is fixed by the bracket 5000 and the supporting post 3300, and in the drilling process, the drilling device 2000 requires maintaining the drill bit to move along the drilling direction thereof, the lifting device 1200 is provided to move the drilling device 2000 in the bracket 5000. The lifting device 1200 includes a lifting board 1201, a piston cylinder 1205 and a hydro-cylinder 1210. Both the piston cylinder 1205 and the hydro-cylinder 1210 are built into a side wall of the housing 1000, the lifting board 1201 is set close to an inner surface of the housing 1000 by a part of the lifting board 1201 being radial distribution within the housing 1000, which forms a plate structure from the inner wall of the housing 1000 pointing towards a central axis of the housing 1000, so that the drilling device 2000 is placed on the lifting board 1201.

A piston rod 1204 that is arranged on the piston cylinder 1205 is configured to push a connecting block 1203 that is connected with the piston rod 1204, the connecting block 1203 sequentially connected to a sliding block 1202 and the lifting board 1201, in this way, all the connecting block 1203, the sliding block 1202 and the lifting board essentially form a whole structure, so that a pushing object of the piston rod 1204 arranged on the piston cylinder 1205 is essentially the lifting board 1201, and the lifting board 1201 moves the same distance as the piston rod 1204. A lifting recess 1212 is arranged on an inner surface of the housing 1000 parallel to the drilling rod 4000, and a sliding groove 1213 is arranged on a side wall of the housing 1000 parallel to the drilling rod 4000, so that the piston rod 1204 can push the connecting block 1203 to move in the sliding groove 1213, and then drive the sliding block 1202 that is connected with the sliding groove 1213 to move synchronously in the lifting recess 1212, so as to further drive the lifting board 1201 that is connected to the sliding block 1202 to move synchronously on the side wall of the housing 1000 along the lifting recess 1212.

The hydro-cylinder 1210 is configured to supply oil to the piston cylinder 1205 through a pipeline, and drive the piston rod 1204 to move in the sliding groove 1213. The hydro-cylinder 1210 is connected to an oil circuit of the piston cylinder 1205 through a reflux pathway 1206 and a drainage pathway 1208 that are respectively arranged in the housing 1000, a switch 1207 arranged on the reflux pathway 1206. In some embodiments of the present disclosure, the switch 1207 can be, but is not limited to, a manual switch, a wired electromagnetic switch and a wireless remote control switch; in order to easy to operate the switch 1207 and save an internal space of the housing 1000, in an embodiment of the present disclosure, the switch 1207 is a manual switch. An operating end of the switch 1207 is arranged on the surface of the housing 1000; an one-way valve 1209 is arranged on the drainage pathway 1208, with a passing direction of the one-way valve 1209 from the piston cylinder 1205 to the hydro-cylinder 1210. A spring-piston 1211 is received in the hydro-cylinder 1210 and configured to provide a pressure to hydraulic oil within the hydro-cylinder 1210. It can be seen that the spring-piston 1211 always provides the pressure to the hydraulic oil within the hydro-cylinder 1210, so that a trend of the hydraulic oil flowing from the hydro-cylinder 1210 to the piston cylinder 1205 is occurred. However, the one-way valve 1209 is arranged on the drainage pathway 1208, so that the hydraulic oil can't enter the piston cylinder 1205 from the drainage pathway 1208, and can only enter the piston cylinder 1205 through the reflux pathway 1206. When the switch 1207 is closed, the hydraulic oil can enter the hydro-cylinder 1210 only along a direction from the piston cylinder 1205, to apply the pressure to the spring-piston 1211. The spring-piston 1211 provide the pressure to the hydraulic oil in the piston cylinder 1205 under a reset force of the spring-piston 1211, at this time, the drilling device 2000 is placed on the lifting board 1201 to maintain at a stable state. During the drilling process, it is necessary to push the drilling device 2000 to make the drilling rod 4000 penetrate deeper into the rock. When an axial pressure is applied to the drilling device 2000, both the drilling device 2000 and the lifting board 1201 can be pushed together to move towards a direction pointed by the drilling rod 4000. After the drilling device 2000 has completed to drill the rock, the switch 1207 that is close is opened, the spring-piston 1211 under its reset force, will return additional hydraulic oil that is filled in the hydro-cylinder 1210 due to compression of the drilling device 2000, to the piston cylinder 1205 through the reflux pathway 1206, in this way, the piston rod 1204 pushes the lifting board 1201 to move to the top of the lifting recess 1212 along the lifting recess 1212, so as to prepare for a next lifting support of the drilling device 2000.

The drilling device 2000 includes a grip 2300 arranged thereon, when the drilling device 2000 is received inside the housing 1000, the grip 2300 extends out of the housing 1000 and is located on a side of the drilling device 2000 opposite to the drilling rod 4000. During the drilling process, the grip 2300 is held to stabilize the drilling device 2000, and the overall gravity center of the drilling device 2000 is stabilized between the bracket 5000 and the supporting post 3300 to obtain a stable drilling of the drilling device 2000. In some embodiments of the present disclosure, a cover 1300 is hinged on the housing 1000 and configured to limit the drilling device 2000 within the housing 1000, that is, the drilling device 2000 is clamped inside the housing 1000 to prevent vibrations during the drilling process from causing the drilling device 2000 to detach from the housing 1000. The grip 2300 passes through the cover 1300 that limits the drilling device 2000 in a restricted state, and then extends out of the housing 1000, so that the grip 2300 is not obstructed to be gripped.

For ease of portability, the supporting post 3300 is preferably a fixed telescopic structure, in some embodiments of the present disclosure, the supporting post 3300 can be a damping telescopic structure, a bolt fixed telescopic structure, or a threaded telescopic structure. In an embodiment of the present disclosure, the supporting post 3300 includes an outer sleeve 3301 and an inner sleeve 3302 threaded inside the outer sleeve 3301, the outer sleeve 3301 including a connecting portion 3303 coaxially connected with the rotating member 3100, and the inner sleeve 3302 configured to adjust a length of the inner sleeve 3302 that extends out of the outer sleeve 3301. That is, the supporting post 3300 is composed of a threaded telescopic structure in the form of inner and outer sleeves, and the connecting portion 3303 is threaded connected with the rotating member 3100.

The backpack drilling machine of the present disclosure is operated, after the backpack drilling machine is transferred to a sampling area, all the housing, the drilling device, the drilling rod, the drill bit, the core barrel, the bracket, and other components are successively assembled according to structures shown in FIG. 1 and FIG. 10, and the angle between the housing and the bracket is adjusted according to an actual terrain and drilling needs; at the same time, the supporting posts are set to support adjacent support points, and the number of the supporting posts can be reduced according to actual needs, so as to provide a stable support environment for the drilling device, and then the drilling device can be tilted to perform drilling sampling on the rock, thereby effectively improving application scenarios of the backpack drilling machine.

At the same time, in situations where vertical downward drilling sampling can be carried out, on the one hand, the drilling device can be selected to remove from the housing to be directly used vertically; and on the other hand, the drilling device can also be used by providing the housing; at this time, the supporting post arranged on the seat can be used as a stable support to support the drilling device to vertically drill downwardly to collect rock samples, to ensure the stability of the drilling device during the vertical drilling process, further improve qualities of the rock samples that have been collected, and effectively avoid problems such as a drilling inclination and a vibration jamming. It can be seen that the backpack drilling machine equipped with an auxiliary support system of the present disclosure not only facilitates portability, but also effectively ensures the stability of drilling the rock samples, which has a broad application range thereof.

In the description of the present disclosure, it needs to be explained that all the directional indicators (such as the terms: "upper", "lower", "front", "rear", "left", "right", "top", "bottom", "inner" and "outer" etc.), are shown in the specification of the present disclosure. The indicated orientation or position of the terms shown in the detailed description is based on the orientation or position shown in the figures of the accompanying drawings of the present disclosure, which is only to easily simplify the description of the present disclosure, but not indicated that the devices or elements of the present disclosure should have a particular orientation or should be designed and operated in a particular orientation. So the terms illustrated in the detail description are not by way of the limitation of the present disclosure.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. A geological sampling backpack drilling machine comprising a housing, a drilling device and a seat; wherein the housing is an internal-hollow container, with at least one set of limiting rotators arranged on a surface thereof for connecting with a bracket, the bracket detachably connected to the housing through the at least one set of limiting rotators to play a supporting role applied on the housing; and a first included angle can take any value within a range of 0°-90° by the at least one set of limiting rotators, and wherein the first included angle is an angle that is formed between the bracket and a first plane, and the first plane is a plane parallel to a horizontal plane where an axis of the housing is located; and wherein the drilling device is connected to a drilling rod and configured to drive the drilling rod and a corresponding drilling equipment to move, a surface of the drilling device matched with an interior of the housing, so that the drilling device can move within the housing; and wherein the seat is set on the surface of the housing, arranged between a tip of the drilling rod and the bracket and rotates around the drilling rod; a rotating handle arranged on a surface of the seat and configured to control a rotation of the seat, at least two sets of rotating members arranged on the surface of the seat and distributed around the drilling rod for detachably connecting with a supporting post, a second included angle taken any value within the range of 0°-90° by the at least two sets of rotating members, wherein the second included angle is a common plane angle between the supporting post and the drilling rod; and wherein the drilling rod passes through the surface of the housing and the seat, respectively.

2. The geological sampling backpack drilling machine as claimed in claim 1, wherein the at least one set of limiting rotator comprises at least two sets of supporting clips, a connecting block and a fixing groove, both the at least two sets of supporting clips and the fixing groove arranged on the surface of the housing, and a rotating shaft connected between the at least two sets of supporting clips, the connecting block sleeved on the rotating shaft to rotate around the rotating shaft that are formed between two supporting clips, an opening formed on the connecting block and connected with the bracket, and a contacting piece arranged on the connecting block to rotate around the rotating shaft; a limiting rod with a spring arranged on the fixing groove to move in the fixing groove under an action of the spring, so that the limiting rod can be in contact with the contacting piece that rotates to any position around the rotating shaft, to fix the contacting piece at a current position thereof; a bolt threaded in the fixing groove and being in contact with the limiting rod so that the limiting rod is fixed by both the bolt and the spring that are in contact with the limiting rod.

3. The geological sampling backpack drilling machine as claimed in claim 2, wherein a contact surface of the contacting piece that is in contact with the limiting rod is a rough surface with a plurality of teeth thereof, and a contact surface of the limiting rod that is in contact with the contacting piece is also a rough surface, each of the plurality of teeth clamped with the rough surface of the limiting rod to fix the limiting rod.

4. The geological sampling backpack drilling machine as claimed in claim 2, wherein a plurality of slots is arranged on the limiting rod, the bolt extending into each of the plurality of slots to fix the limiting rod.

5. The geological sampling backpack drilling machine as claimed in claim 1, wherein a lifting device is received in the housing for supporting the drilling device to move, the lifting device comprising a lifting board, a piston cylinder and a hydro-cylinder, both the piston cylinder and the hydro-cylinder built into a side wall of the housing, the lifting board set close to an inner surface of the housing by a part of the lifting board being radial distribution within the housing, the drilling device placed on the lifting board and moving together with the lifting board towards the drilling rod, a piston rod arranged on the piston cylinder and configured to push a connecting block that is connected with the piston rod, the connecting block sequentially connected to a sliding block and the lifting board, a lifting recess arranged on an inner surface of the housing parallel to the drilling rod, a sliding groove arranged on a side wall of the housing parallel to the drilling rod, so that the piston rod can push the connecting block to move in the sliding groove, and then drive the sliding block that is connected with the sliding groove to move synchronously in the lifting recess, so as to further drive the lifting board that is connected to the sliding block to move synchronously on the side wall of the housing along the lifting recess; the hydro-cylinder configured to supply oil to the piston cylinder through a pipeline, and drive the piston rod to move in the sliding groove.

6. The geological sampling backpack drilling machine as claimed in claim 5, wherein the hydro-cylinder is connected to an oil circuit of the piston cylinder through a reflux pathway and a drainage pathway that are respectively arranged in the housing; a switch arranged on the reflux pathway, and an operating end of the switch arranged on the surface of the housing; an one-way valve arranged on the drainage pathway, with a passing direction of the one-way valve from the piston cylinder to the hydro-cylinder; a spring-piston received in the hydro-cylinder and configured to provide a pressure to hydraulic oil within the hydro-cylinder.

7. The geological sampling backpack drilling machine as claimed in claim 1, wherein a core barrel is detachably arranged on the drilling rod and configured to collect rock samples.

8. The geological sampling backpack drilling machine as claimed in claim 1, wherein the drilling device comprises a grip arranged thereon; when the drilling device is received inside the housing, the grip extends out of the housing and is located on a side of the drilling device opposite to the drilling rod.

9. The geological sampling backpack drilling machine as claimed in claim 8, wherein a cover is hinged on the housing and configured to limit the drilling device within the housing, the grip passing through the cover that limits the drilling device in a restricted state, and then extending out of the housing.

10. The geological sampling backpack drilling machine as claimed in claim 1, wherein the supporting post comprises an outer sleeve and an inner sleeve threaded inside the outer sleeve, the outer sleeve comprising a connecting portion coaxially connected with the rotating member, and the inner sleeve configured to adjust a length of the inner sleeve that extends out of the outer sleeve.

* * * * *